US009393815B2

(12) United States Patent
Kanda et al.

(10) Patent No.: US 9,393,815 B2
(45) Date of Patent: Jul. 19, 2016

(54) PRINTER WITH DETECTOR FOR DETECTING REFERENCE PORTION OF A RECORDING MEDIUM AND RECORDING MEDIUM FOR USE THEREWITH

(71) Applicants: Mitsuhiro Kanda, Nagoya (JP); Satoru Moriyama, Nagoya (JP)

(72) Inventors: Mitsuhiro Kanda, Nagoya (JP); Satoru Moriyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/179,674

(22) Filed: Feb. 13, 2014

(65) Prior Publication Data

US 2014/0227017 A1 Aug. 14, 2014

(30) Foreign Application Priority Data

Feb. 14, 2013 (JP) ..... 2013-027021

(51) Int. Cl.
*B41J 11/46* (2006.01)
*B41J 29/38* (2006.01)
*B41J 3/407* (2006.01)

(52) U.S. Cl.
CPC ..... *B41J 11/46* (2013.01); *B41J 3/4075* (2013.01); *B41J 29/38* (2013.01)

(58) Field of Classification Search
CPC ..... B41J 11/46; B41J 3/4075
See application file for complete search history.

(56) References Cited

U.S. PATENT DOCUMENTS

| | | | | |
|---|---|---|---|---|
| 9,042,743 | B2 | 5/2015 | Sakurai | |
| 2010/0074635 | A1 | 3/2010 | Sakurai | |

FOREIGN PATENT DOCUMENTS

| | | | | |
|---|---|---|---|---|
| JP | 56036021 | A * | 4/1981 | ..... G01G 23/40 |
| JP | 63242667 | A * | 10/1988 | ..... B41J 15/00 |
| JP | 01288469 | A * | 11/1989 | ..... B41J 11/42 |
| JP | H06-227066 | A | 8/1994 | |
| JP | 2004358920 | A * | 12/2004 | ..... B41J 29/38 |
| JP | 2008238484 | A | 10/2008 | |
| JP | 2010-184362 | A | 8/2010 | |
| JP | 2010228843 | A * | 10/2010 | ..... B41J 11/42 |

OTHER PUBLICATIONS

Apr. 8, 2016—(JP) Reasons for Rejection—App 2013-02721.

* cited by examiner

*Primary Examiner* — Daniel J Colilla
(74) *Attorney, Agent, or Firm* — Banner & Witcoff, Ltd.

(57) ABSTRACT

A printer comprises a feeder, a printing head, and a detecting device. The feeder feeds a print-receiving tape having multiple print-receiving portions, each of the print-receiving portions having a detected element. The printing head forms desired printing on the print-receiving tape. The detecting device detects the detected element, provided on an upstream side of the printing head by a predetermined distance X. A first positioning reference is generated when the detecting device detects the detected element of a first print-receiving portion. The printing head may be controlled, when the detecting device detects the detected element of the first print-receiving portion, to perform print formation on a second print-receiving portion preceding the first print-receiving portion and facing the printing head, using the first positioning reference.

2 Claims, 13 Drawing Sheets

PRINTER WITH DETECTOR FOR DETECTING REFERENCE PORTION OF A RECORDING MEDIUM AND RECORDING MEDIUM FOR USE THEREWITH

CROSS-REFERENCE TO RELATED APPLICATION

The present application claims priority from Japanese Patent Application No. 2013-27021, which was filed on Feb. 14, 2013, the disclosure of which is incorporated herein by reference in its entirety.

BACKGROUND

The present disclosure relates to a printer and recording medium capable of forming desired print while feeding a print-receiving tape, thereby producing a plurality of printed matter.

DESCRIPTION OF THE RELATED ART

There are known printers capable of forming desired print while feeding a print-receiving tape, thereby producing a plurality of printed matter.

According to such printers referred to as so-called label printers and the like, desired printing is performed on a label mount provided on the print-receiving tape in a strip shape at a fixed interval, and the printing interval depends on a size setting of the label by an application installed in a personal computer or the like.

On the other hand, with the diversification of label types in recent years, a printer that makes it possible to perform printing on a small label for printing numerical values, such as a price tag, sell-by date, consumption expiration date, or manufacturing date, has been desired.

Nevertheless, in the case of such a small label, with the aforementioned setting of the printing interval (label interval) based on label size, the problem arises that misalignment readily occurs due to the printing interval being set based on label size and margin settings as if no space exists between adjacent labels, or due to the difference between the setting unit, such as millimeters, inches, or dots, and the actual distance between labels, for example.

Such misalignment, even if 0.1 mm per label, ends up being a misalignment of 1 mm by the tenth label and, in a case where the aforementioned small label is used in particular, causes a defect in which the print of the price, date, or the like ends up protruding from the label.

SUMMARY

It is therefore an object of the present disclosure to provide a printer and recording medium capable of performing positioning control with high accuracy at the time of print formation, and suppressing the occurrence of print position misalignment.

In order to achieve the above-described object, according to the aspect of the present application, there is provided a printer capable of forming desired print while feeding a print-receiving tape, thereby producing a plurality of printed matter, comprising a feeder configured to feed the print-receiving tape comprising a plurality of print-receiving portions with a length along a feeding direction of L, wherein each of the print-receiving portions comprises a detected element for identifying the print-receiving portion, for each of the plurality of printed matter, a printing head configured to form the desired print on the print-receiving tape fed by the feeder, a detecting device configured to detect the detected element of the plurality of print-receiving portions, provided on an upstream side than the printing head by a predetermined distance X that is longer than the length L, along the feeding direction, a first reference generating portion configured to generate a first positioning reference when the detecting device detects the detected element of a first print-receiving portion, based on the detection result, and a first print control portion configured to control the printing head when the detecting device detects the detected element of the first print-receiving portion, and perform the print formation on a second print-receiving portion preceding the first print-receiving portion along a feeding direction and facing the printing head, by means of using the first positioning reference generated by the first reference generating portion.

BRIEF DESCRIPTION OF THE DRAWINGS

FIG. 5 shows the print-receiving tape applied to the label producing apparatus, wherein

DETAILED DESCRIPTION OF THE PREFERRED EMBODIMENTS

The following applies an embodiment of a printer of the present disclosure to a label producing apparatus, describing the embodiment with reference to accompanying drawings.

General Outer Appearance Configuration

First, the general outer appearance configuration of a label producing apparatus 1 as the printer of this embodiment will be described using FIG. 1. Note that the front-rear direction, left-right direction (width direction), and up-down direction in the descriptions below refer to the directions of the arrows suitably shown in each figure, such as FIG. 1.

Figure 1:
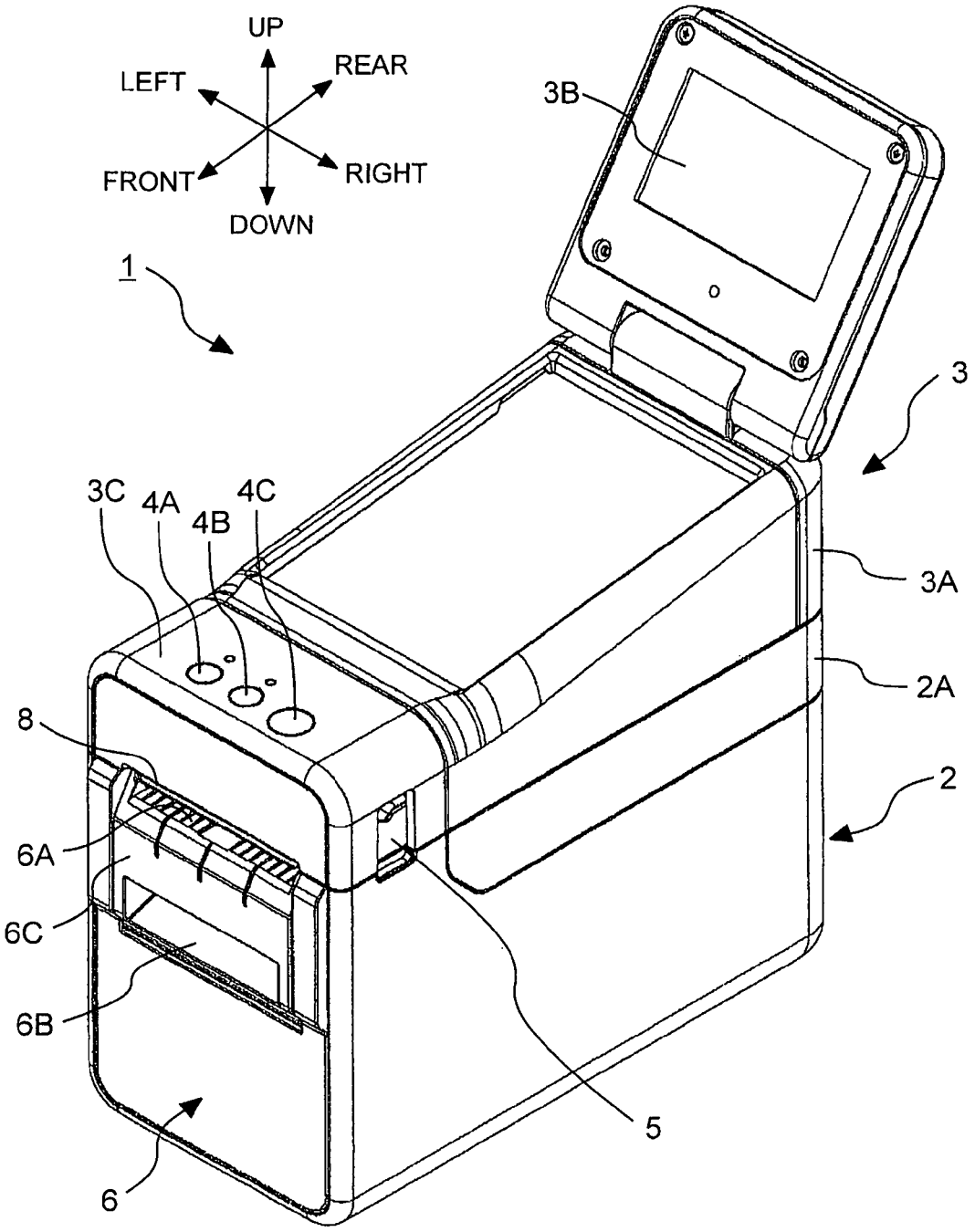
FIG. 1 is a perspective view showing the outer appearance of the label producing apparatus as a printer according to an embodiment of the present disclosure.

In FIG. 1, the label producing apparatus 1 comprises a housing 2 and an upper cover unit 3 that constitutes the upper portion of the housing 2. The housing 2 and the upper cover unit 3 are made of resin, for example. The upper cover unit 3 comprises a framework portion 3A, a substantially rectangular-shaped liquid crystal panel portion 3B, and an operation button portion 3C.

The upper cover unit 3 is pivotably connected to the housing 2 at the rearward end portion via a rotating shaft portion 2*a* (refer to FIG. 4 described later), forming a structure capable of opening and closing with respect to the housing 2. Note that a housing cover portion 2A constituting a part of the above described housing 2 is integrally configured with the lower portion of the upper cover unit 3, causing the housing cover portion 2A to also open and close in an integral manner during the opening and closing of the upper cover unit 3 (refer to FIG. 2 described later).

The liquid crystal panel portion 3B is pivotably connected to the framework portion 3A at the rearward end portion via a rotating shaft portion 3*a* (refer to FIG. 4 described later), forming a structure capable of opening and closing with respect to the framework portion 3A. Note that a touch panel portion (not shown) for settings and operations, which is separate from the liquid crystal panel portion 3B, is disposed on the framework portion 3A.

The operation button portion 3C is disposed on an upper surface position on the frontward side of the upper cover unit 3, and disposes a power supply button 4A of the label producing apparatus 1, a status button 4B for displaying the peripheral device operation status, a feed button 4C, and the like.

A release tab 5 is disposed on both left and right side walls of the housing 2 (only the one positioned on the right side surface is shown in FIG. 1). Pressing this release tab 5 upward releases the locking of the upper cover unit 3 to the housing 2, making it possible to open the upper cover unit 3.

A first discharging exit 6A and a second discharging exit 6B positioned in an area on the downward side of the first discharging exit 6A are disposed on a front panel 6 constituting the frontward side of the housing 2. Further, the section of the front panel 6 that comprises the second discharging exit 6B forms an opening/closing lid 6C pivotable toward the frontward side to improve the convenience of installation of a roll TR described later, paper ejection, and the like, for example.

The first discharging exit 6A is formed by a front surface upper edge portion of the housing 2 and a front surface lower edge portion of the upper cover unit 3 when the upper cover unit 3 is closed. Note that a cutting blade 8 is disposed on the lower edge inner side of the first discharging exit 6A side of the front panel 6, facing downward (refer to FIGS. 2-4 described later).

Inner Structure

Figure 3:
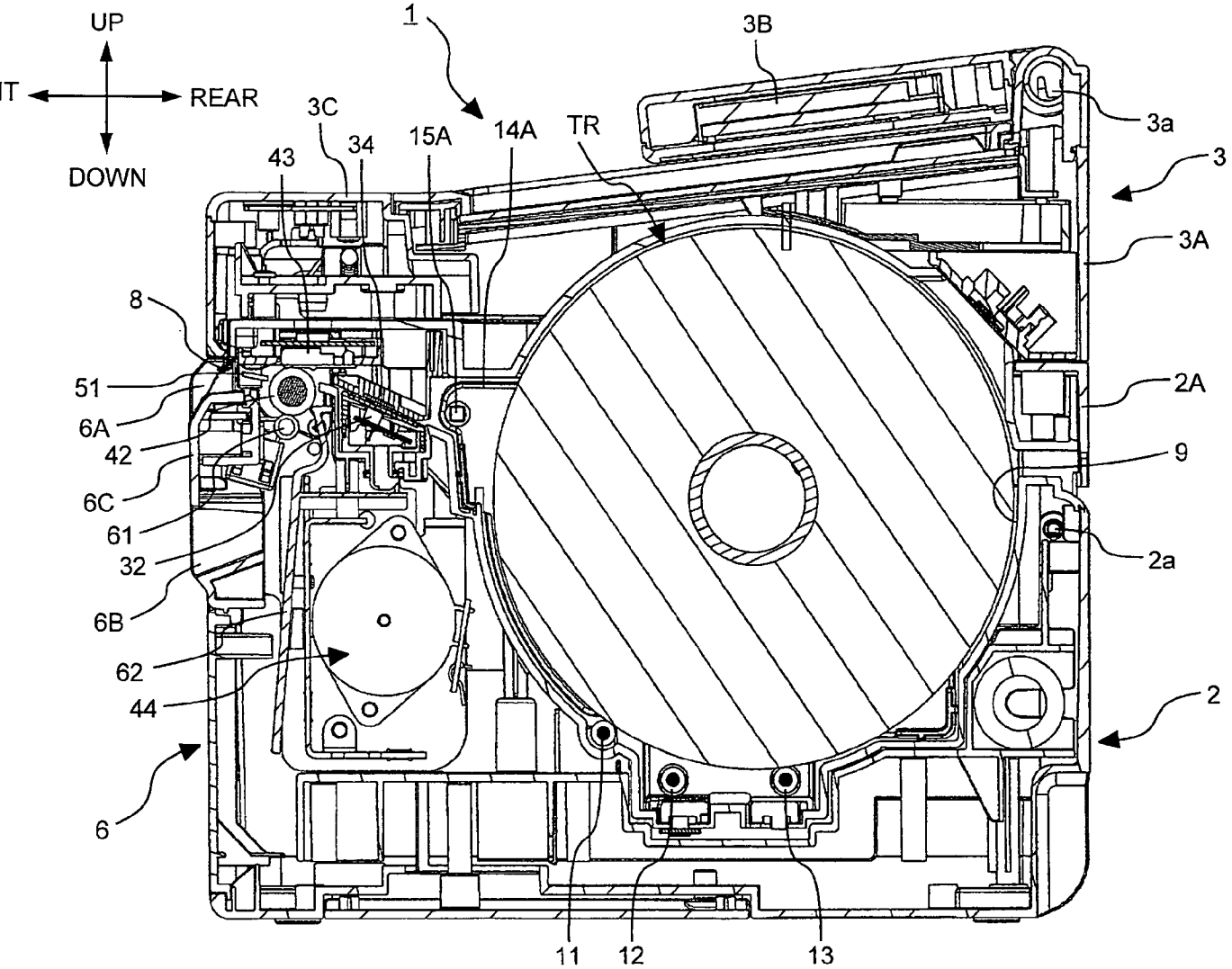
FIG. 3 is a side sectional view showing the overall structure of the label producing apparatus.
Figure 4:
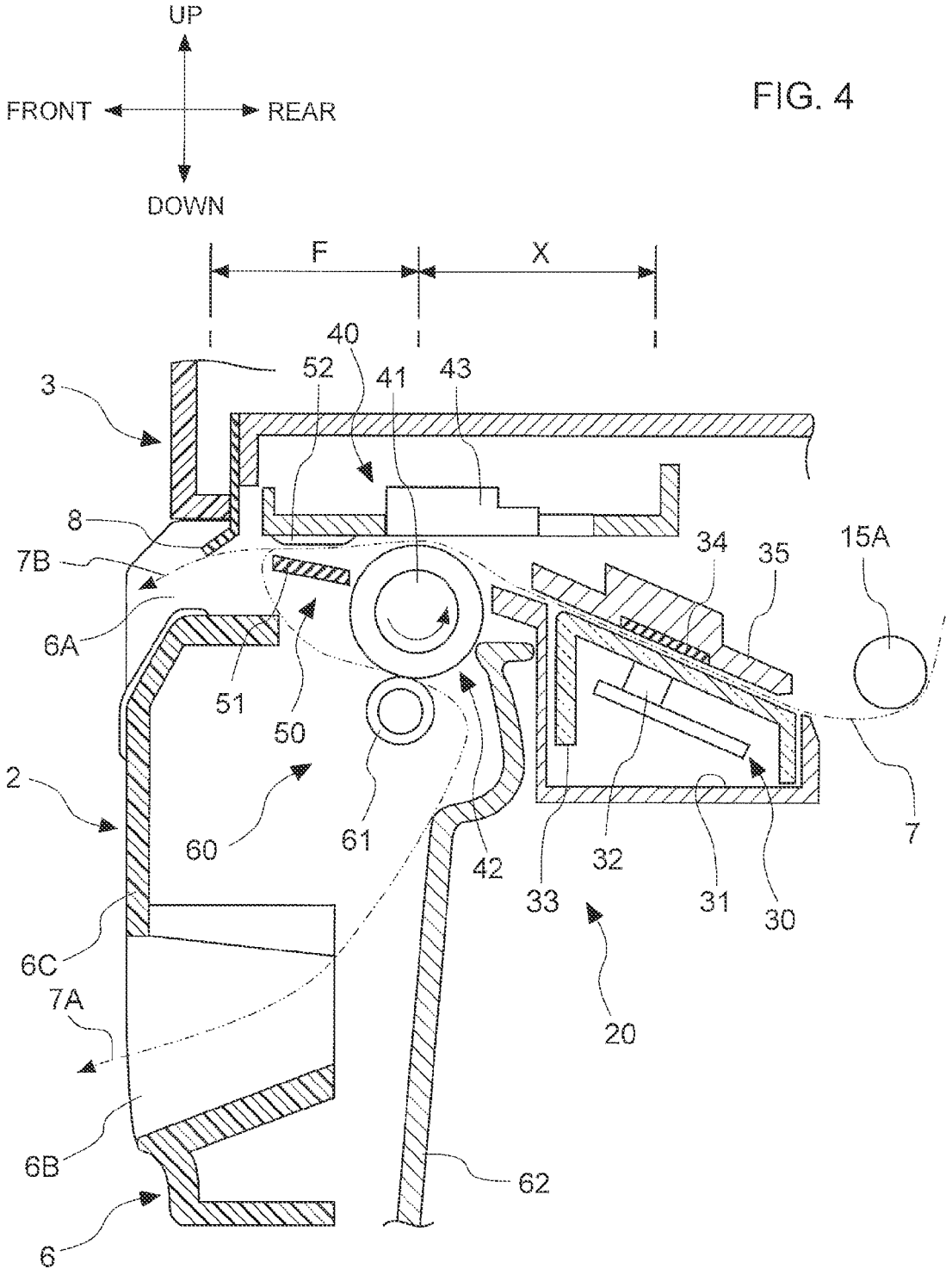
FIG. 4 is a side sectional view showing the main structure of the label producing apparatus.

Next, the inner structure of the label producing apparatus 1 of this embodiment will be described using FIG. 2, FIG. 3, and FIG. 4.

Figure 2:
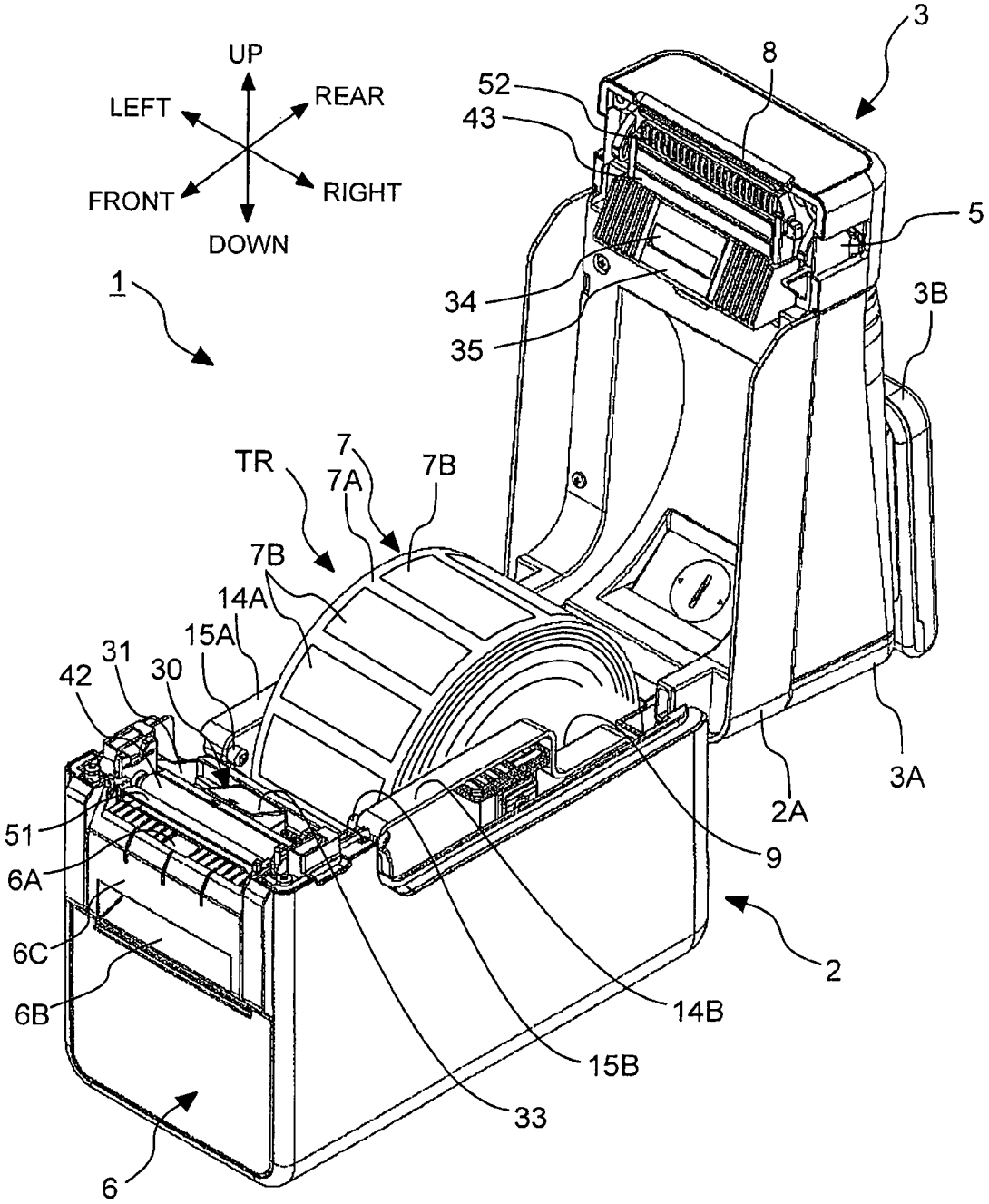
FIG. 2 is a perspective view showing the label producing apparatus with the upper cover unit open.

As shown in FIG. 2, the label producing apparatus 1 comprises a recessed roll storage portion 9 on the rearward side of the interior of the housing 2. The roll storage portion 9 stores the roll TR around which is wound a print-receiving tape (equivalent to the print-receiving medium) 7 with a preferred width in a roll shape along the left-right direction of the label producing apparatus 1 so that the print-receiving tape 7 is fed out from the upper side of the roll TR.

The roll TR is rotatably stored in the roll storage portion 9 with the axis of the winding of the print-receiving tape 7 in the left-right direction orthogonal to the front-rear direction.

Print-Receiving Tape

Figure 5A:
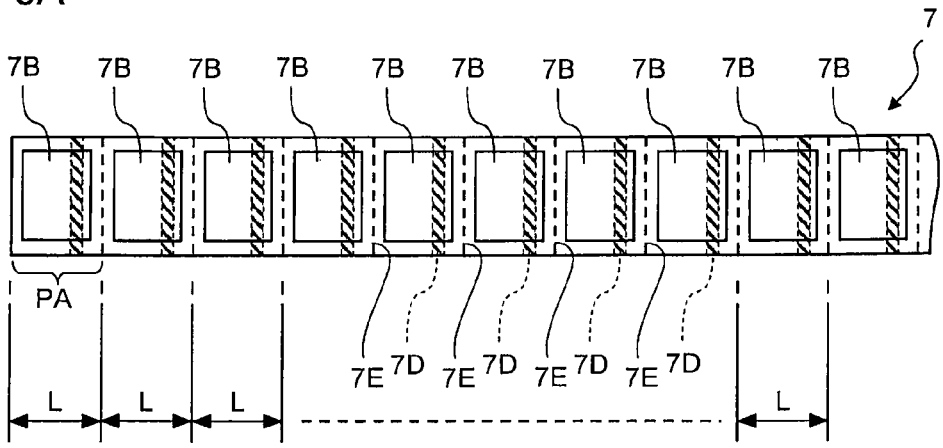
FIG. 5A is a plan view of the print-receiving tape as viewed from the face side.
Figure 5B:
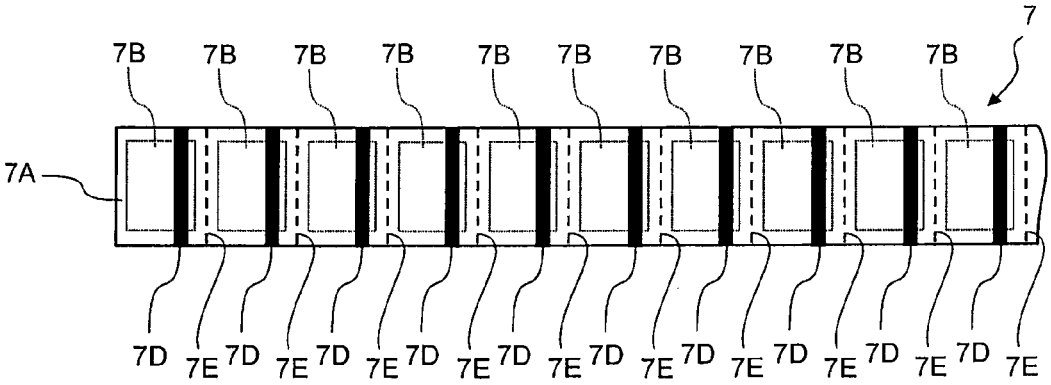
FIG. 5B is a bottom view of the print-receiving tape as viewed from the back side.
Figure 5C:
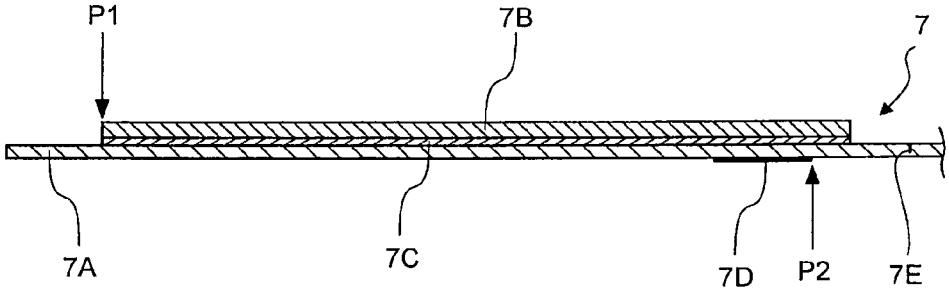
FIG. 5C is an enlarged sectional view of the main part of the print-receiving tape.

As shown in FIG. 2 and FIG. 5, a label mount 7B (equivalent to the print-receiving label portion) used for a price tag or the like, for example, is consecutively disposed on the face surface of a separation material layer 7A (equivalent to the separation material portion) of the print-receiving tape 7 constituting the roll TR, along the longitudinal direction at a fixed interval. That is, the face surface of the label mount 7B serves as the print surface on which print is formed and, as shown in FIG. 5C, an adhesive 7C capable of separating the label mount 7B from the separation material layer 7A is disposed on the back surface of the label mount 7B. Then, the label mount 7B is affixed to the face surface of the separation material layer 7A at a fixed interval L by the adhesive force of the adhesive 7C. That is, the print-receiving tape 7 forms a three-layer structure of the label mount 7B, the adhesive 7C, and the separation material layer 7A in the section where the label mount 7B is affixed, and a one-layer structure of only the separation material layer 7A in the section where the label mount 7B is not adhered. The label mount 7B on which printing was completed is, in the end, peeled from the separation material layer 7A along with the adhesive, making it possible to affix the label mount 7B to an adherent such as a predetermined good or the like as a print label (equivalent to the printed matter). Further, a black mark 7D (equivalent to the detected element) for identifying that the label mount 7B exists is disposed on the back surface of the separation material layer 7A by printing or the like, in correspondence with each of the label mounts 7B. This black mark 7D is disposed at a uniform interval in a case where the label mounts 7B are the same size and affixed to the separation material layer 7A at a uniform interval. Note that the black mark 7D may be, for example, a notch formed on at least one edge portion of the separation material layer 7A, or the like. Further, while the black mark 7D is disposed across the entire width of the separation material layer 7A in FIG. 5, it may be disposed across a part of the width. Furthermore, in place of the black mark 7D, a step-shaped portion generated by the above described label mount 7B and the separation material layer 7A may be detected as the detected element (so-called gap detection). Furthermore, a perforation may be disposed on the separation material layer 7A at a boundary 7E positioned (in the middle) between each of the label mounts 7B to make separation (cutting) by the operator easy. Furthermore, one section (hereinafter suitably "page PA"; refer to FIG. 5 and FIG. 6) between the adjacent boundary 7E and the boundary 7E of the print-receiving tape 3A is equivalent to the print-receiving portion described in the claims.

Support Rollers

Three support rollers 11-13 are disposed on the bottom surface portion of the roll storage portion 9. The support rollers 11-13 drivingly rotate by contacting the outer peripheral surface of the roll TR store in the roll storage portion 9, thereby rotatably supporting the roll TR. At this time, at least two of the support rollers 11-13 (the support rollers 11, 13 in FIG. 3) contact the outer peripheral surface of the roll TR in accordance with the roll diameter that decreases according to the pulled out amount (used amount) of the end portion side of the print-receiving tape 7. These three support rollers 11-13 vary in position in the circumferential direction with respect to the roll TR, and are disposed in the order of the first support roller 11, the second support roller 12, and the third support roller 13, along the circumferential direction of the roll TR, from the front toward the rear. These three support rollers 11-13 are divided into a plurality of sections in the left-right direction (in other words, the roll width direction), and only the sections on which the roll TR is mounted rotate in accordance with the width of the roll TR.

Guide Members

Guide members 14A, 14B that contact the left and right end surfaces of the roll TR and guide the print-receiving tape 7 in the left-right direction (that is, the tape width direction) are disposed on the roll storage portion 9. The guide member 14A and the guide member 14B move close to and away from each other by advancing and retreating along the left-right direction. Then, each of the guide members 14A, 14B contact the left and right end surfaces of the roll TR, thereby guiding the print-receiving tape 7 while sandwiching the roll TR from both end surfaces. Since both of the guide members 14A, 14B are thus disposed in an advanceable and retreatable manner along the left-right direction, both of the guide members 14A, 14B are made to advance and retreat and adjust position in accordance with the width of the roll TR stored in the roll storage portion 9, thereby making it possible to sandwich the roll TR with any width by both of the guide members 14A, 14B and guide the width direction of the print-receiving tape 7.

Guide Protrusions

Further, guide protrusions 15A, 15B are disposed protruding inward along the left-right direction on the upper portion of the frontward side of each of the guide members 14A, 14B. With this arrangement, the flopping of the print-receiving tape 7 in the up-down direction is suppressed at both end portions of the print-receiving tape 7 fed out from the roll TR as previously described, making it possible to reliably perform smooth feeding.

Printing Portions

In the label producing apparatus 1, a printing portion 20 where desired printing is performed on the face surface of the label mount 7B while the print-receiving tape 7 is pulled out from the roll TR stored in the roll storage portion 9 is disposed on the frontward side of the interior of the housing 2. A sensor unit 30, a print unit 40, and a separation portion 50 are disposed on the printing portion 20 in that order in the path from the guide protrusions 15A, 15B (only the one guide protrusion 15A is shown in the figure) to the first discharging exit 6A, as shown in FIG. 3 and FIG. 4. Further, the separation portion 50 is branched with a paper ejection guide portion 60 that guides the print-receiving tape 7 toward the second discharging exit 6B.

Configuration of the Sensor Unit 30

The sensor unit 30 optically detects a predetermined reference position of the print-receiving tape 7 on the frontward side of the roll storage portion 9 (the rearward side of the print unit 40). The sensor unit 30, as shown in FIG. 4, comprises a sensor main body 32 (equivalent to the detecting device), a cover 33 made of a translucent material, positioned on the front surface side of the sensor main body 32 (above the label producing apparatus 1), and a reflecting portion 35 integrally comprising a reflecting plate 34 facing the sensor main body 32. The sensor main body 32 and the cover 33 are disposed integrally movable along the width direction (that is, the left-right direction) of the print-receiving tape 7 in a storage concave portion 31 that is disposed on the upper surface of the housing 2 and formed substantially across the entire width along the left-right direction of the housing 2. The reflecting portion 35 is disposed on the lower surface of the upper cover unit 3, and faces the sensor main body 32 when the upper surface of the housing 2 is covered by the upper cover unit 3.

In case a plurality of types of print-receiving tapes 7 comprising various widths is used, the sensor main body 32 and the cover 33 are movably disposed along the width direction (that is, the left-right direction) of the print-receiving tape 7 orthogonal to the feeding direction of the print-receiving tape 7 in the storage concave portion 31. The sensor main body 32 is a known reflective sensor comprising a light-emitting portion and a light-receiving portion (both not shown). According to this embodiment, the light emitted from the light-emitting portion of the sensor main body 32 is reflected by the reflecting plate 34 of the reflecting portion 35 after being transmitted through the print-receiving tape 7, and received by the light-receiving portion of the sensor main body 32 after being transmitted through the print-receiving tape 7 once again, and the end portion position of the label mount 7B in the feeding direction as well as the black mark 7D are detected based on the difference in the amount of light received of the reflected luminous flux.

That is, the print-receiving tape 7 is a three-layer structure comprising the label mount 7B, the adhesive 7C, and the separation material layer 7A in the section where the label mount 7B is adhered as previously described, and a one-layer structure of only the separation material layer 7A in the section where the label mount 7B is not adhered (in the section between the label mounts 7B). As a result, for example, the end portion position of the label mount 7B in the feeding direction and the black mark 7D are detected based on the difference in the amount of light received by the light-receiving portion of the sensor main body 32 according to the difference between the thickness of the three-layer structure of the label mount 7B, the adhesive 7C, and the separation material layer 7A and the thickness of the one-layer structure of only the separation material layer 7A, as well as the light-absorbing behavior by the black mark 7D. Accordingly, transmittance is determined in such a manner that the difference in the amount of light appears in three patterns: an amount of light received by the light-receiving portion of the sensor main body 32 caused by the thickness of the three-layer structure of the label mount 7B, the adhesive 7C, and the separation material layer 7A; an amount of light received by the light-receiving portion of the sensor main body 32 caused by the thickness of the one-layer structure of only the separation material layer 7A; and an amount of light received when transmitted through the black mark 7D.

According to this embodiment, the sensor unit 30 detects the tip end position of the label mount 7B in the feeding direction (the position of the downstream-side end portion) as a print reference position P1, and the rear end position of the black mark 7D in the feeding direction as an interval reference position P2, for example, as shown in FIG. 5C. Note that detection of the interval reference position P2 is possible by detecting the aforementioned gap instead of detecting the black mark 7D, or by optional selection or combined use thereof. Further, to make the distance from the print reference position P1 to the interval reference position P2 equal the length along the feeding direction of the actual label mount 7D, that length can be used. Similarly, the length from the interval reference position P2 to the next print reference position P1 is the gap length of the adjacent label mounts 7D.

Note that the reflecting plate 34 may serve as the light-receiving portion 34, and the light emitted from the light-emitting portion of the sensor main body 32 may be received by the light-receiving portion 34 after being transmitted through the print-receiving tape 7 and, based on the difference in the amount of light received by the light-receiving portion 34 of the luminous flux, the end portion position of the label mount 7B in the feeding direction may be detected as the reference position.

Configuration of the Print Unit 40

The print unit 40 comprises a platen roller 42 wherein a roller shaft 41 is rotatably held by the housing 2, a print head 43 disposed on the lower surface of the upper cover unit 3 so as to face the platen roller 42, and a drive motor 44 (shown only in FIG. 3) that rotates the platen roller 42 via a gear (not shown) fixed to the roller shaft 41 of the platen roller 42.

At this time, the disposed position of the platen roller 42 in the housing 2 corresponds to the installation position of the print head 43 in the upper cover unit 3. Then, with the closing of the upper cover unit 3, the print-receiving tape 7 is sandwiched by the print head 43 disposed on the upper cover unit 3 side and the platen roller 42 disposed on the housing 2 side, making it possible to perform printing by the print head 43. Further, with the closing of the upper cover unit 3, the gear fixed to the roller shaft 41 of the platen roller 42 meshes with a gear train (not shown) on the housing 2 side, and the platen roller 42 is rotationally driven by the drive motor 44. With this arrangement, the platen roller 42 feeds out the print-receiving tape 7 from the roll TR stored in the roll storage portion 9, and the print-receiving tape 7 is fed in a posture in which the tape width direction thereof is in the left-right direction.

The print head 43 is supported in the middle part thereof and urged downward by a suitable spring member (not shown). The upper cover unit 3 is changed to an open state by the release tab 5, causing the print head 43 to separate from the platen roller 42. On the other hand, with the closing of the upper cover unit 3, the print head 43 presses and urges the print-receiving tape 7 toward the platen roller 42 by the urging force of the spring member, making printing possible.

Note that the roll TR is configured by winding the print-receiving tape 7 into a roll shape so that the label mount 7B is positioned on the outside in the diameter direction. As a result, the print-receiving tape 7 is fed out from the upper side of the roll TR with the surface of the label mount 7B side facing upward (refer to the chain double-dashed line in FIG. 4), and print is formed by the print head 43 disposed on the upper side of the print-receiving tape 7. Print control of the print head 43, such as determination of the print start position and the like, is performed based on the detection result of the sensor unit 30.

Configuration of the Separation Portion 50

The separation portion 50 comprises a separation plate 51 positioned on the frontward side of the platen roller 42 and held by the housing 2, and a rib member 52 disposed on the lower surface of the upper cover unit 3 so as to face the separation plate 51.

The separation plate 51 peels the label mount 7B and the adhesive 7C from the separation material layer 7A by looping back the print-receiving tape 7 to the downward side of the platen roller 42 further on the frontward side than the platen roller 42. The label mount 7B with print and the adhesive 7C peeled from the separation material layer 7A by the above described separation plate 51 are discharged to outside of the housing 2 via the first discharging exit 6A positioned further on the frontward side than the separation plate 51. The cutting blade 8 is used to cut the label mount 7B and the adhesive 7C discharged to the outside of the housing 2 via the first discharging exit 6A at a position preferred by the operator.

The rib member 52 contacts the print-receiving tape 7 from above, and the feeding path of the print-receiving tape 7 is set substantially linear. With this arrangement, it is possible to most favorably and efficiently peel the label mount 7B by the separation plate 51. At this time, the rib member 52 is used, making it possible to decrease the contact surface area when contacting the print-receiving tape 7 from above. As a result, compared to a case where the contact from above is performed by a fixed member comprising a face surface with a flat plate shape or a pressure roller, it is possible to reliably prevent the occurrence of feeding faults as well as an increase in feeding resistance.

Configuration of the Paper Ejection Guide Portion 60

The paper ejection guide portion 60 guides the separation material layer 7A, which was looped back at the tip end side of the separation plate 51 to peel the label mount 7B, toward the second discharging exit 6B. The paper ejection guide portion 60 comprises a pinch roller 61 that contacts the platen roller 42, and a cover member 62 disposed on the rearward side from the pinch roller 61 to the second discharging exit 6B.

The pinch roller 61 drivingly rotates by the rotation of the platen roller 42 by contacting the platen roller 42 from below. The pinch roller 61 feeds the print-receiving tape 7 looped back to the downward side by the separation plate 51, sandwiching the print-receiving tape 7 with the platen roller 42. The print-receiving tape 7 fed by the pinch roller 61 is discharged from the second discharging exit 6B to the outside of the housing 2. The cover member 62 guides the discharge of the print-receiving tape 7 at this time. Note that this pinch roller 61 is disposed on the opening/closing lid 6C via a suitable support member (not shown).

Overview of Feeding of Print-Receiving Tape

In the above described configuration, when the upper cover unit 3 is closed and the platen roller 42 is rotationally driven by the drive motor 44, the print-receiving tape 7 is pulled. With this arrangement, the print-receiving tape 7 is fed out from the roll TR while the width direction is guided by the guide member 14A and the guide member 14B. The print-receiving tape 7 fed out from the roll TR is subjected to printing by the print head 43, and then looped back to the downward side of the platen roller 42 by the separation plate 51. At this time, taking advantage of the fact that the firm label mount 7B cannot follow such a loop-back path, the label mount 7B and the adhesive 7C are peeled from the print-receiving tape 7 as previously described. The label mount 7B and the adhesive 7C (in other words, the label mount 7B) thus peeled by the separation plate 51 are discharged to the outside of the housing 2 from the first discharging exit 6A and used as a print label. Note that FIG. 4 shows the feeding path of the print-receiving tape 7 fed out and fed from the roll TR using a chain double-dashed line.

Control System

Figure 6:
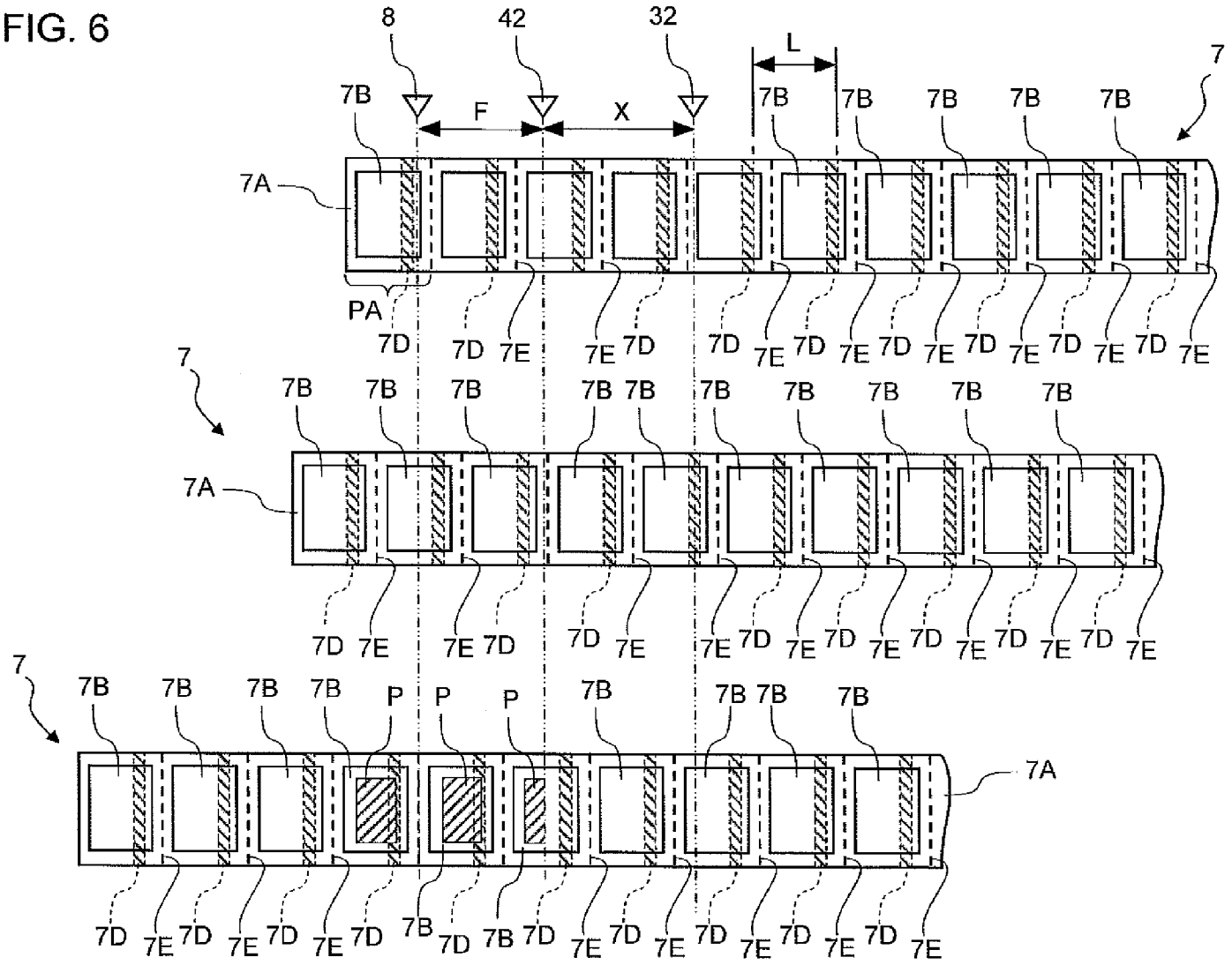
FIG. 6 is an explanatory view showing the relationship between the feeding process of the print-receiving tape and the detection status by the sensor unit, in time series.

According to this embodiment, the sensor unit 30, as shown in FIG. 6, can properly control the detection accuracy of the print reference position P1 and the interval reference position P2 as well as the printing interval between the label mounts 7B while minimizing waste of the label mount 7B, even in a case where a distance X (22.5 mm, for example) from the sensor main body 32 (using the detection center as reference) to the platen roller 42 (using a nip section of the print head 43 as reference) and a distance F (18.5 mm, for example) from the platen roller 42 to the cutting blade 8 (using the tip end as reference), and the like are longer than the fixed interval L of the adjacent pages PA (in other words, the label mounts 7B) according to mechanical restrictions.

Specifically, as shown in FIG. 2, the label mount 7B of each of the pages PA is continuously disposed on the print-receiving tape 7 like strips of paper, and printing is preferably performed on the label mount 7B of each of the pages PA, with a short mount width along the tape feeding direction of even less than one inch (a label for a price tag or consumption expiration date specification, for example).

In such a case, although printing on the label mount 7B of the adjacent pages PA with the fixed interval L shorter than the distance X from the sensor main body 32 to the print head 43 (hereinafter simply referred to as the "distance X") is not impossible, the problem arises that print misalignment readily occurs.

Hence, when an interval s (hereinafter referred to as the "set interval") according to the setting of the personal computer or the like (not shown) and the actual fixed interval L of the label mounts 7B affixed to the separation material layer 7A are misaligned, the amount of misalignment accumulates on a per label basis. As a result, even if the misalignment per label is 0.1 mm, the misalignment becomes 1 mm by the tenth label.

Hence, for example, even if there is misalignment between the set interval according to the personal computer and the fixed interval L, if the black mark 7D is detected on a per label basis and the print-receiving tape 7 is fed out from that point in an amount corresponding to the set interval, the misalignment can be maintained at 0.1 mm by the tenth label as well even if there is a misalignment of 0.1 mm between the set interval and the fixed interval L.

At this time, the boundary 7E arrives at the cutting position if the print-receiving tape 7 is simply fed a distance (X+F) up to the cutting blade 8 after detection of the black mark 7D by the sensor main body 32, but the following plurality of pages PA pass through the sensor main body 32 and the printing portion 20 in that distance (X+F) from the sensor main body 32 to the cutting blade 8. Moreover, the distance X and the distance F are both intervals that differ from the fixed interval L of the label mount 7B (in other words, the page PA; hereinafter the same).

Hence, a threshold value (24 mm, for example) of the minimum set interval is set for the fixed interval L of such the label mount 7B in advance, and regular print processing is performed in a case where the set interval according to the personal computer is greater than or equal to the threshold value, and short medium print processing is performed in a case where the set interval according to the personal computer is less than the threshold value. Note that the set interval used for this regular printing is the sum of the print length along the feeding direction of the print-receiving tape 7, the margin (non-print section) of the page PA, and the separation distance between the adjacent label mounts 7B. Further, the threshold value of the minimum set interval can be set according to a function of the printer.

For the short medium print processing, a total of four blank label mounts 7B are fed further frontward than the sensor main body 32 when the initial position in which the roll TR is inserted serves as the state of the upper part of FIG. 6, such as when replacing the roll TR, for example. Further, the set interval is input and set in advance by the personal computer (not shown), and the distance X from the sensor main body 32 to the print head 43 is known data.

Accordingly, after the sensor main body 32 detects the print reference position P1 of one label mount (the fifth label mount from the left) 7B and, as shown in the middle part of FIG. 6, subsequently detects the interval reference position P2 of the black mark 7D, at least another label mount (the fourth label mount from the left) 7B preceding along the feeding direction of the print-receiving tape 7 exists in a printable position in front of (or facing) the print head 43.

Hence, at the moment the fifth label mount 7B is detected, the fourth label mount 7B is positioned further toward the front than the print unit 40 and therefore the detection result of the fifth label mount 7B (first positioning reference) and the set interval according to the personal computer are utilized to virtually determine the print reference position P1 of the fourth label mount 7B and, as shown in the lower part of FIG. 6, a printing P is performed with reference to the virtual print reference position P1 on the fourth label mount 7B preceding along the feeding direction of the print-receiving tape 7 and facing the print head 43 (first print control).

Then, the printing P of the print on the fifth and subsequent label mounts 7B can be performed using the actual print reference position P1 and the interval reference position P2 detection result of each of the label mounts 7B as reference, making it possible to eliminate defects such as an increase in misalignment with each increase in the number of printed labels, even if misalignment occurs between the set interval according to the personal computer and the fixed interval L of the actual separation material layer 7A, for example. Further, even in the preceding fourth label mount 7B, the detection result (detected position) of the black mark 7D of the following fifth label mount 7B is utilized to set the position corresponding to the set interval according to the personal computer as the virtual print reference position P1. With this arrangement, even if slight misalignment occurs between the actual tip end position of the following fifth label mount 7B and the virtual print reference position P1, it is possible to perform the fourth printing P without significant loss in aesthetic appearance of the print result by performing feeding taking into consideration the difference between the distance X and the set interval according to the personal computer.

Note that every fourth label mount 7B shown in the upper part of FIG. 6 may be left blank and the print processing on this label mount 7B may be skipped, thereby substantially blank feeding the fourth label, and the print processing may be executed while detecting the print reference position P1 or the interval reference position P2 that follows, including the fifth black mark 7D. Further, while the three print-receiving tapes 7 were left blank when the roll TR was inserted for convenience of explanation, the number of blank label mounts 7B decreases if the tip end of the print-receiving tape is inserted in a state that permits the feeding of the print-receiving tape 7, that is, into a position where nip feeding by the platen roller 42 and the print head 43 is possible. Specifically, in the example of the upper part of FIG. 6, the number of blank labels can be decreased by an amount equivalent to the two label mounts 7B on the tip end side, and the fifth label serving as the aforementioned first label mount 7B can serve as the third label, and the fourth label serving as the second label mount 7B can serve as the second label.

Figure 7:
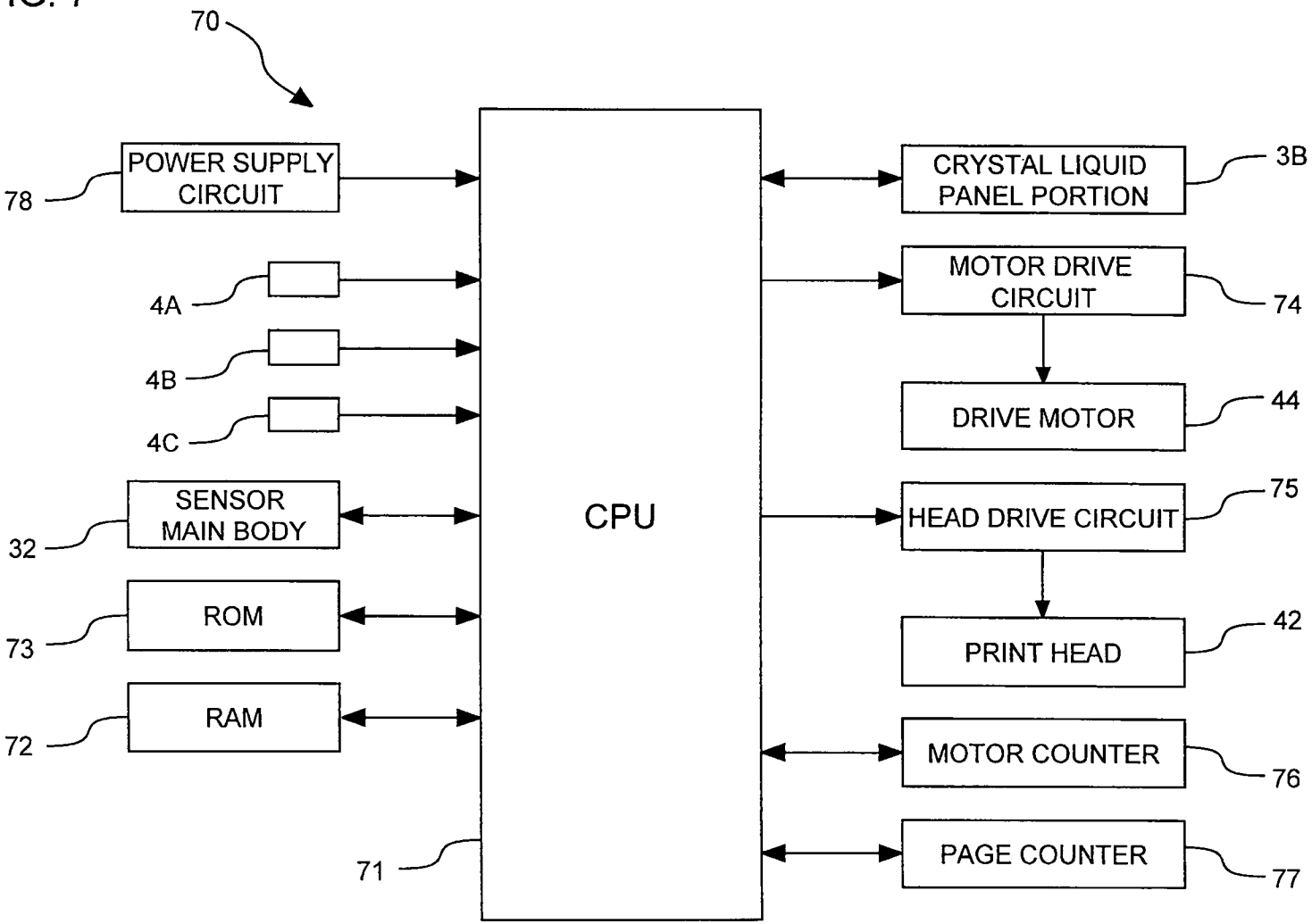
FIG. 7 is a functional block diagram showing the control system of the label producing apparatus.

Next, a control system of the label producing apparatus 1 that realizes the aforementioned print processing (print control) will be described using FIG. 7.

The label producing apparatus 1 comprises a CPU 71 that constitutes a calculating portion that performs predetermined calculations. The CPU 71 performs signal processing in accordance with a program stored in advance in a ROM 73 (equivalent to the recording medium) while utilizing the temporary storage function of a RAM 72, and controls the entire label producing apparatus 1 accordingly. A control program for executing label production processing is stored in the ROM 73. The CPU 71 controls a motor drive circuit 74 that controls the drive of the drive motor 44 that drives the platen roller 42, a head control circuit 75 that controls the conduction of the heating elements of the print head 43, and the liquid crystal panel portion 3B, and is connected to a power supply circuit 78 that controls the power supply from a commercial power supply or a built-in battery. Further, command signals from the power supply button 4A, the status button 4B, the feed button 4C, and the like, and detections signals from the sensor main body 32 are input to the CPU 71. Furthermore, the CPU 71 controls a motor counter 76 that counts the number of driven pitches (lines) of the drive motor 44, and a page counter 77 that counts the number of print processed pages of the label mount 7B.

FIGS. 8-13 are the flowcharts of each routine of print control by the aforementioned CPU 71.

Main Control Routine

Figure 8:
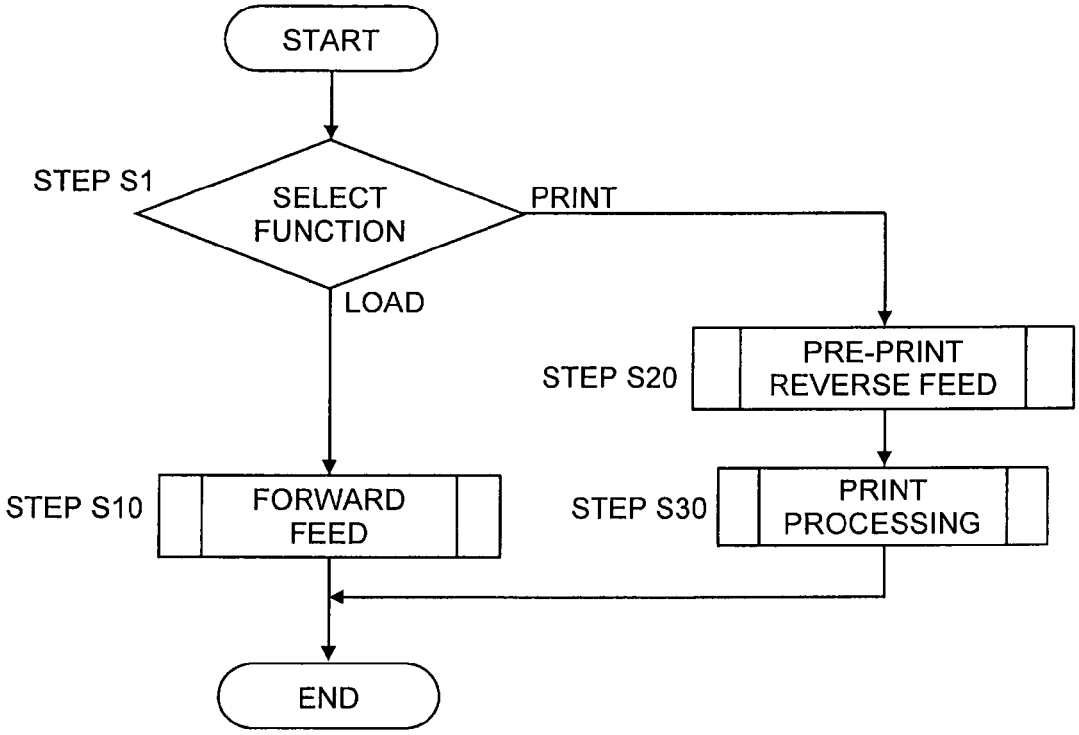
FIG. 8 is a flowchart showing the main control routine of the label producing apparatus.

First, the main routine performed by the CPU 71 will be described based on FIG. 8. The CPU 71 determines if there is a load command or a print command for the label mount 7B by the print setting according to the personal computer (not shown; step S1). The CPU 71 transitions to the forward feed routine of step S10 in the case of the load command, and transitions to the pre-print reverse feed routine of step S20 and then executes the print processing routine of step S30 in the case of the print command.

Forward Feed Routine

Figure 9:
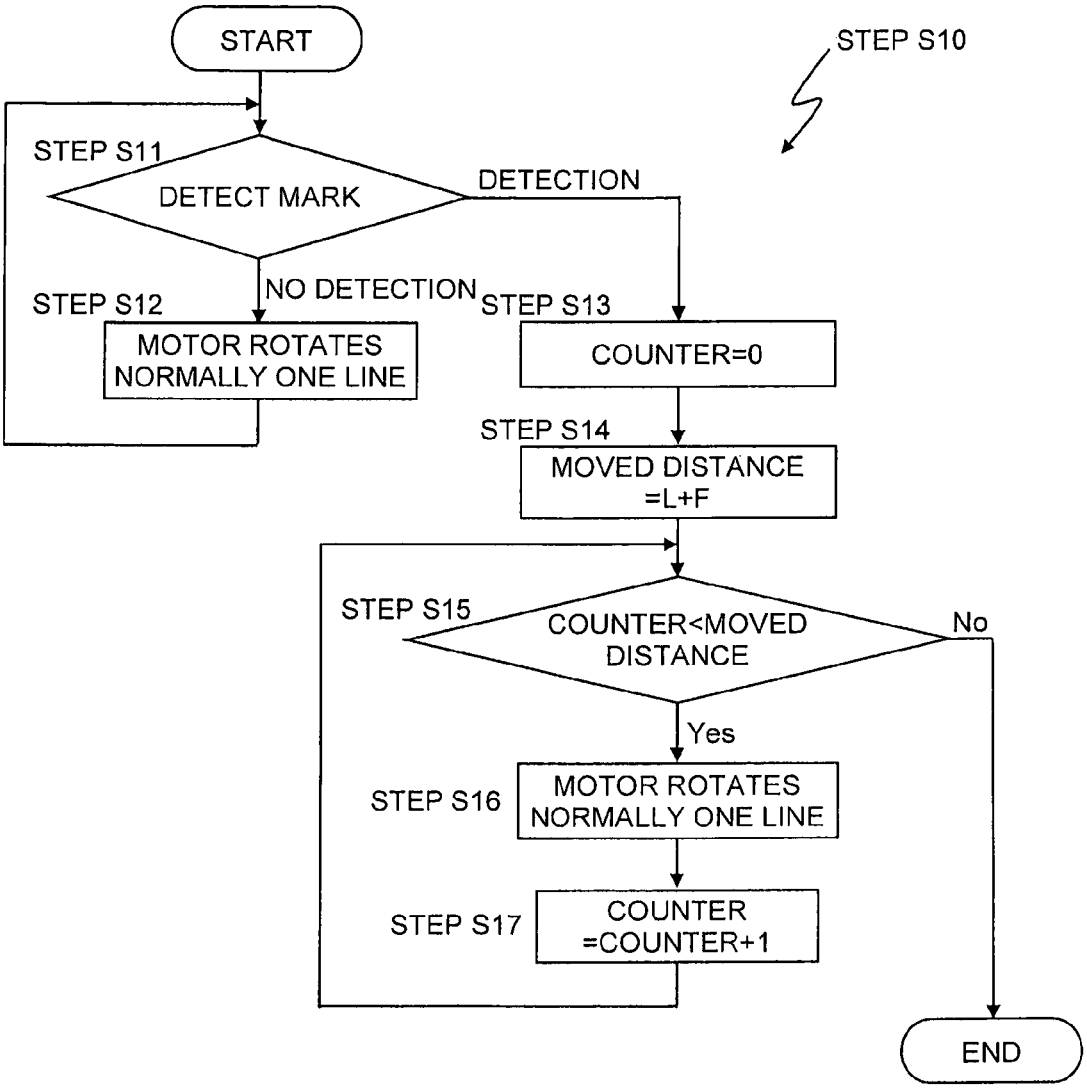
FIG. 9 is a flowchart showing the forward feed routine of the label producing apparatus.

As shown in FIG. 9, in the forward feed routine (step S10), the CPU 71 determines whether or not the sensor main body 32 has detected the black mark 7D (step S11). Note that, in this step S11, the above described gap detection may be substituted for the detection of the black mark 7D.

Further, in a case where the sensor main body 32 has not detected the black mark 7D, the CPU 71 drives the drive motor 44 in an amount equivalent to one line (step S12), loops to step S11 once again, and thereafter repeats the above described routine until the black mark 7D is detected. In a case where the black mark 7D was detected, the CPU 71 sets the count number of the motor counter 76 to 0 (step S13), and sets the moved distance of the print-receiving tape 7 by the drive of the motor drive circuit 74 to a numerical value found by adding the distance from the sensor main body 32 to the cutting blade 8 (X+F) to the length L (step S14).

Furthermore, the CPU 71 determines whether or not the moved distance of the print-receiving tape 7 at this moment (motor counter=0) exceeded the count number of the motor counter 76 (step S15) and, if the moved distance has not exceeded the count number of the motor counter 76, drives the drive motor 44 in an amount equivalent to one line (step S16), increases the count number of the motor counter 76 by an amount equivalent to one line (step S17), loops to step S15 once again, and thereafter repeats the above described routine until the moved distance exceeds the count number.

Pre-Print Reverse Feed Routine

Figure 10:
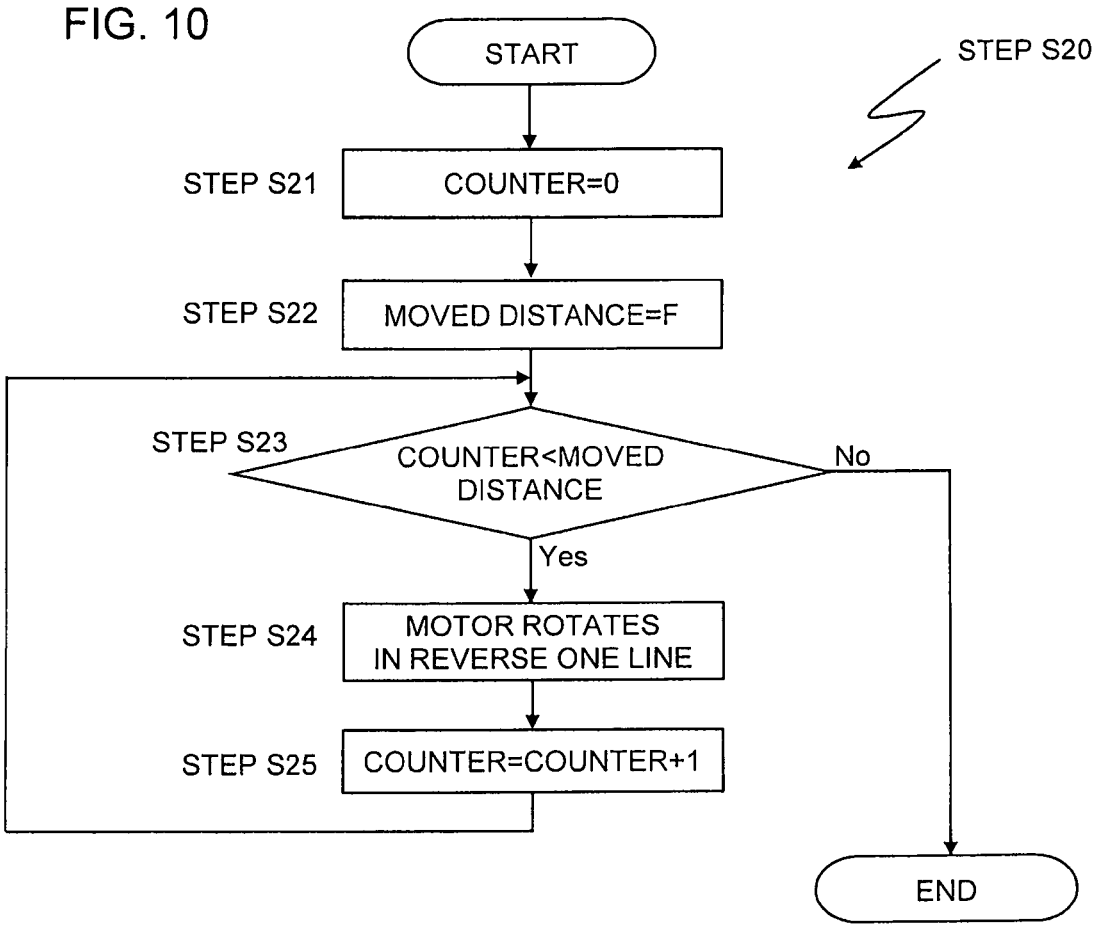
FIG. 10 is a flowchart showing the pre-print reverse feed routine of the label producing apparatus.

As shown in FIG. 10, in the pre-print reverse feed routine (step S20), the CPU 71 sets the count number of the motor counter 76 to 0 (step S21), and sets the moved distance of the print-receiving tape 7 by the drive of the motor drive circuit 74 to the distance F from the platen roller 42 to the cutting blade 8 (using the tip end as reference; step S22).

Furthermore, the CPU 71 determines whether or not the moved distance of the print-receiving tape 7 at this moment (motor counter=0) exceeded the count number of the motor counter 76 (step S23) and, if the moved distance has not exceeded the count number of the motor counter 76, drives the drive motor 44 in reverse in an amount equivalent to one line (step S24), increases the count number of the motor counter 76 by an amount equivalent to one line (step S25), loops to step S23 once again, and thereafter repeats the above described routine until the moved distance exceeds the count number.

Print Routine

Figure 11:
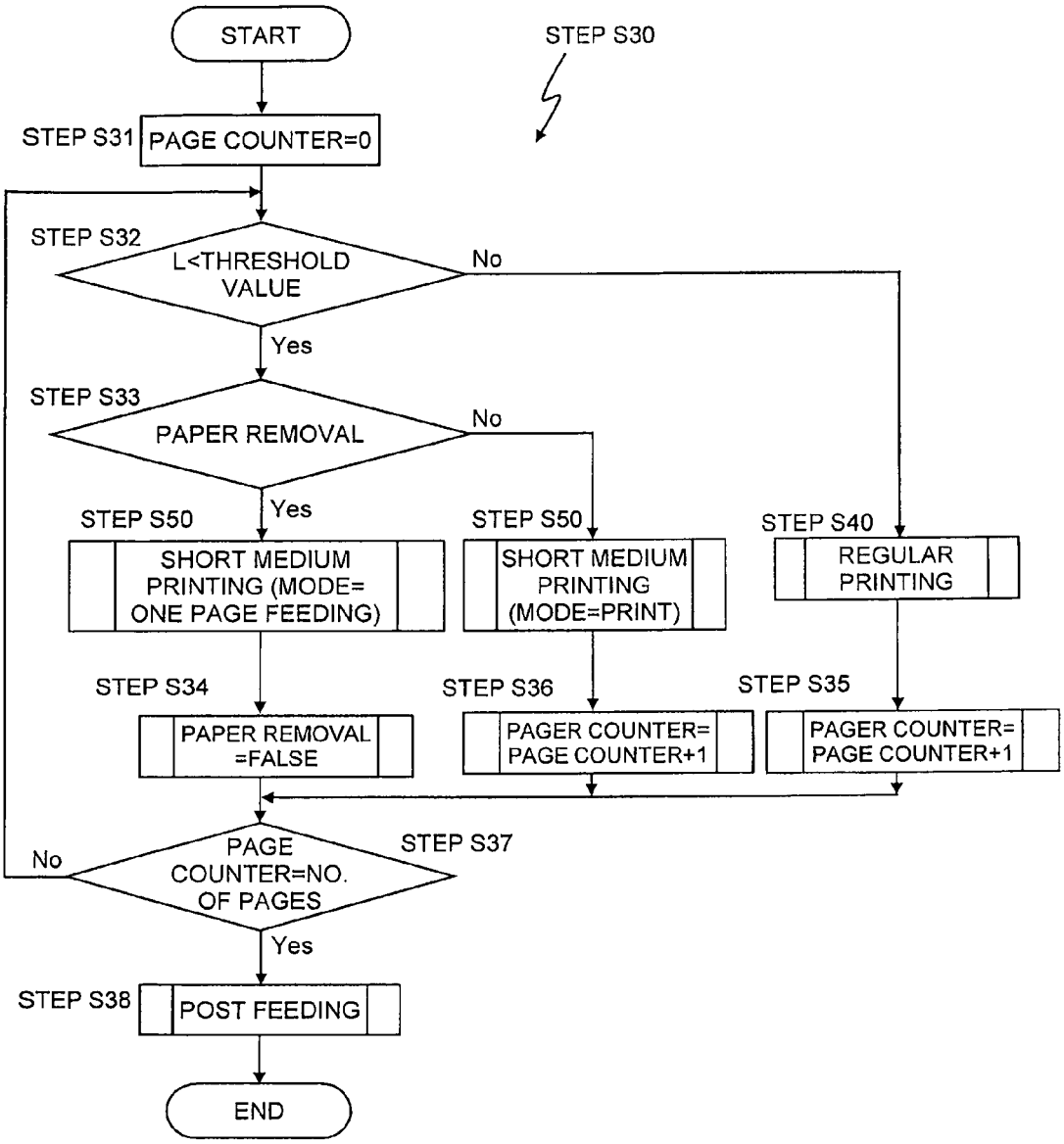
FIG. 11 is a flowchart showing the print routine of the label producing apparatus.

As shown in FIG. 11, in the print routine, the CPU 71 sets the count number of the page counter 77 to 0 (step S31), determines whether or not the fixed interval L of the label mount 7B is smaller than the threshold value (24 mm in the above described case) for determining if the processing is regular print processing or short medium print processing (step S32), transitions to the regular print routine of step S40 in a case where the fixed interval L is larger than the threshold value (No), and transitions to step S33 for short medium print processing in a case where the fixed interval L is smaller than the threshold value (Yes).

The CPU 71 determines whether or not there is a need for paper removal (step S33) and, in a case where there is a need for paper removal, performs the feed processing for one of the label mounts 7B by the short medium print routine (one page feeding mode) of step S50, performs paper removal not required processing (step S34), and transitions to step S37.

After executing the regular print routine of step S40 or the short medium print routine of step S50 (print mode), the CPU 71 increases the count number of the page counter 77 by one (steps S35, S36), and transitions to step S37. Furthermore, the CPU 71 determines whether or not the count number of the page counter 77 performed printing in an amount equivalent to the specified number of pages included in the print command from the personal computer (step S37), loops to step S32 to repeat the above described routine until the printing of the specified number of pages is completed, performs post feeding after the printing of the specified number of pages is completed (step S38), and then ends the routine.

Regular Print Routine

Figure 12:
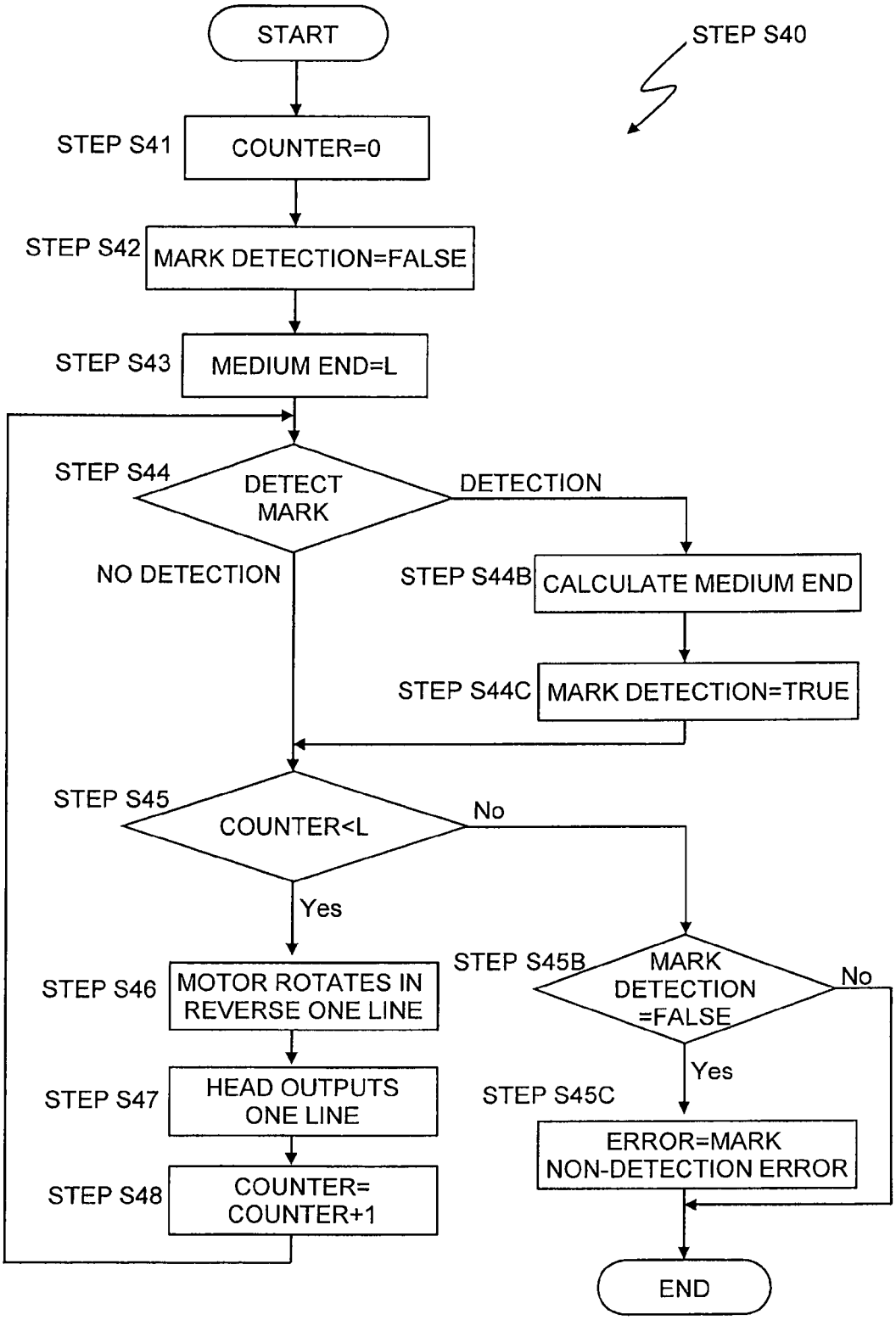
FIG. 12 is a flowchart showing the regular print routine of the label producing apparatus.

As shown in FIG. 12, in the regular print routine S40, the CPU 71 sets the count number of the motor counter 76 to 0 (step S41), clears detection of the black mark 7D (step S42), replaces the medium end interval set by the personal computer with the fixed interval L (step S43), and transitions to step S44.

In this state, the CPU 71 determines whether or not the sensor main body 32 detected the black mark 7D (step S44). In a case where the black mark 7D was detected, the CPU 71 performs medium end calculation processing (step S44B), sets detection of the black mark 7D to detection (step S44C), and transitions to step S45. Further, in a case where the black mark 7D has not been detected, the CPU 71 transitions to step S45.

For the medium end calculation, the CPU 71 sets a numerical value found by adding the distance from the print reference position P1 to the interval reference position P2, which is the length along the feeding direction of the label mount 7B, to the distance X from the sensor main body 32 to the print head 43. Note that, in this step S43, the above described gap detection can be substituted for the detection of the black mark 7D. At this time, in the medium end calculation processing during gap detection, the CPU 71 sets a numerical value found by adding one-half of the gap width, that is, one-half of the distance from the interval reference position P2 to the print reference position P1 of the following label mount 7B, to the distance X.

The CPU 71 determines whether or not the count number of the motor counter 76 reached the fixed interval L (step S45) and, if not, drives the drive motor 44 in an amount equivalent to one line (step S46), performs printing in an amount equivalent to one line by the print head 43 (step S47), increases the count number of the motor counter 76 by an amount equivalent to one line (step S48), loops to step S44 once again, and thereafter repeats the above described routine until the count number of the motor counter 76 exceeds the fixed interval L.

On the other hand, in a case where the count number of the motor counter 76 exceeded the fixed interval L, the CPU 71 sets the detection result of the black mark 7D to no detection (step S45B), issues a notice regarding a black mark 7D non-detection error (step S45C), and ends the routine.

Short Medium Print Routine

Figure 13:
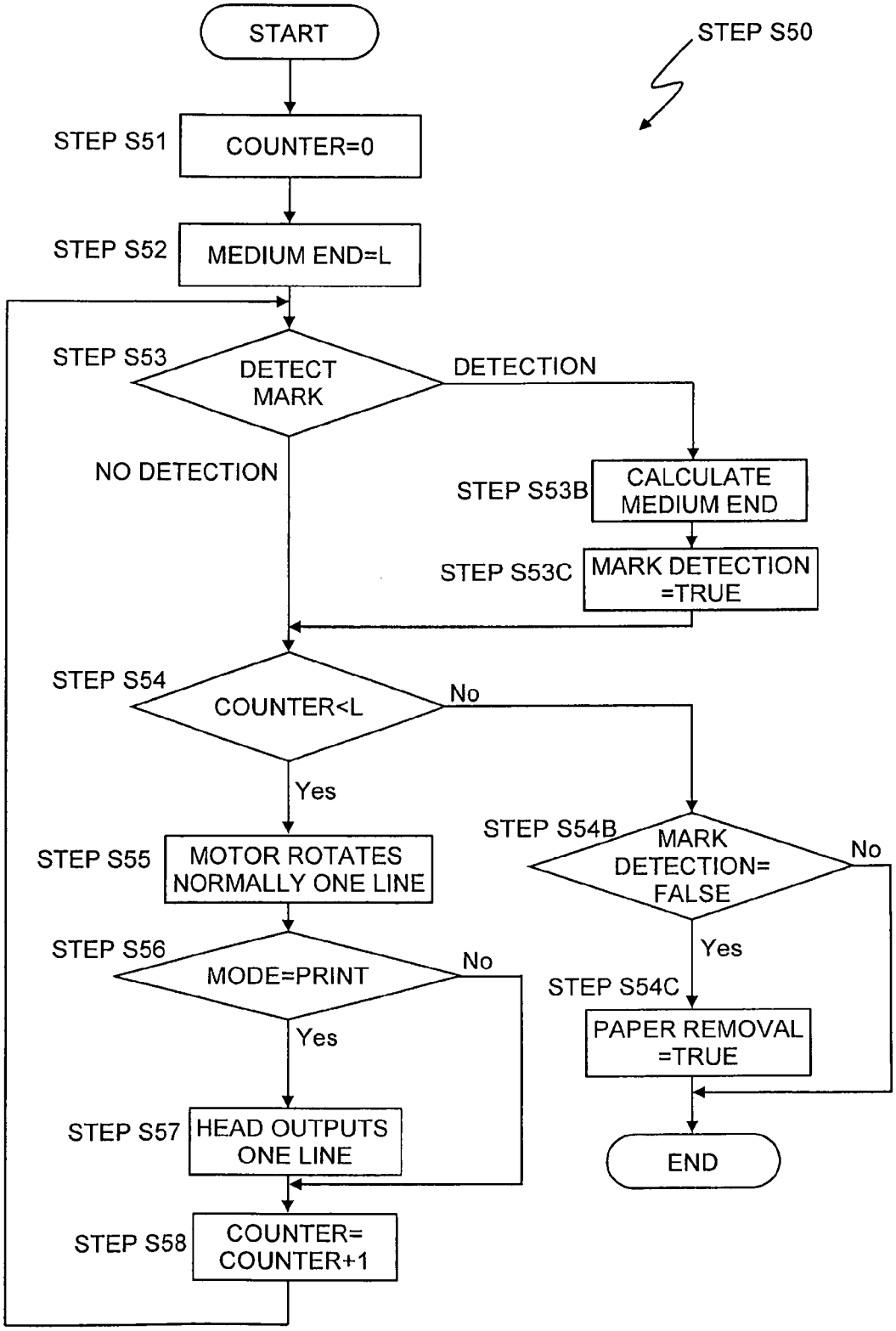
FIG. 13 is a flowchart showing the short medium print control routine of the label producing apparatus.

As shown in FIG. 13, in the short medium print routine S50, the CPU 71 sets the count number of the motor counter 76 to 0 (step S51), replaces the medium end interval set by the personal computer to the fixed interval L (step S52), and transitions to step S53.

In this state, the CPU 71 determines whether or not the sensor main body 32 detected the black mark 7D (step S53). In a case where the black mark 7D was detected, the CPU 71 calculates the fixed interval L, which is the medium end (step S53B), sets detection of the black mark 7D to detection (step S53C), and transitions to step S45. Further, in a case where the black mark 7D has not been detected, the CPU 71 transitions to step S54.

The CPU 71 performs the medium end calculation as follows:

$$\text{Medium end} = \text{Distance } X \text{ from the sensor main body 32 to the print head 43} - (\text{Distance from } P1 \text{ to } P2 \times \text{Number of the label mounts } 7B \text{ that exist across the distance } X) - \text{Distance from } P2 \text{ to the following } P1 + \text{Count value of the motor counter 76}$$

Note that, in this step S53, the above described gap detection can be substituted for the detection of the black mark 7D. At this time, the CPU 71 performs the medium end calculation processing during gap detection as follows:

$$\text{Medium end} = \text{Distance } X \text{ from the sensor main body 32 to the print head 43} - (\text{Distance from } P1 \text{ to } P2 \times \text{Number of the label mounts } 7B \text{ that exist across the distance } X) - \text{One-half of the gap width} + \text{Count value of the motor counter 76}$$

The CPU 71 determines whether or not the count number of the motor counter 76 reached the fixed interval L (step S54) and, if not, drives the drive motor 44 in an amount equivalent to one line (step S55). Furthermore, the CPU 71 determines if the mode of the short medium print routine is print mode or one page feeding mode (step S56) and, in the case of print mode, performs printing in an amount equivalent to one line by the print head 43 (step S57), increases the count number of the motor counter 76 by an amount equivalent to one line (step S58), loops to step S44 once again, and thereafter repeats the above described routine until the count number of the motor counter 76 exceeds the fixed interval L. Furthermore, in the case of one page feeding mode, the CPU 71 skips to step S58.

On the other hand, in a case where the count number of the motor counter 76 exceeded the fixed interval L, the CPU 71 sets the detection result of the black mark 7D to no detection (step S54B), sets the paper removal signal to paper removal (step S54C), and ends the routine.

While a case where the label mount 7B exists at the fixed interval is presumed in the above described embodiment, a case where the label mount 7B peels off due to unexpected reasons such as human-induced reasons, including an operational error by an operator during replacement of the roll TR or the like, or other incidental reasons, is possible.

In such a case, the aforementioned short medium print routine is executed, and therefore the length L fluctuates. Hence, for example, in a case where the above described gap detection is performed by the sensor main body 32 separately from detection of the black mark 7D in step S53 and the gap value detected at present exceeds the length of the label mount 7B (the distance between P1 and P2) or the fixed length L in contrast to the previous detection, the CPU 71 may determine that the label mount 7B has peeled off and fallen (functioning as the peel-off detecting portion), feed the print-receiving tape 7 so that the printing of step S57 is not performed or skipped (prohibited) in an amount equivalent to that peeled off and fallen (functioning as the prohibit control portion). With this arrangement, it is possible to prevent mistaken printing on the separation material layer 7A of the above described fallen area. Further, it is also possible to reliably prevent mistaken misrecognition of an out-of-tape state due to the fallen area and the stopping of the printing operation, skip the fallen area only, and subsequently continue print formation on the label mount 7B that follows.

As described above, in this embodiment, the printer is a printer capable of forming desired print while feeding the print-receiving tape 7, thereby producing a plurality of printed matter. That is, the printer has the platen roller 42 for feeding the print-receiving tape 7 comprising the plurality of pages PA with a length (fixed interval) along the feeding direction of the print-receiving tape 7 of L, wherein each of the pages PA comprises the black mark 7D for identifying the page PA, for each of the plurality of printed matter, the print head 43 that forms desired print on the print-receiving tape 7 fed by the platen roller 4, and the sensor main body 32 that detects the black mark 7D of the plurality of pages PA, disposed further on the upstream side than the print head 43 by a predetermined distance X that is longer than the length L along the feeding direction of the print-receiving tape 7. The printer generates the first positioning reference when the sensor main body 32 detects the black mark 7D of the page PA (equivalent to the first print-receiving portion) based on the detection result, controls the print head 43, and performs print formation on the page PA (equivalent to the second print-receiving portion) preceding the first print-receiving portion along the feeding direction of the print-receiving tape 7 and facing the print head 43, using the first positioning reference.

Note that the present disclosure is not limited to the embodiment, and various modifications may be made without deviating from the spirit and scope of the disclosure.

For example, while the above has been described in connection with an illustrative scenario in which the print-receiving tape 7 wherein the label mount 7B is consecutively disposed at a fixed interval is used, the present disclosure is not limited thereto, allowing printing to be performed on a print-receiving tape comprising a thermal layer or image-receiving layer across the entire tape face surface and the print label to be produced by cutting the print-receiving tape at a predetermined length, and thus the present disclosure can be applied to such configurations as well.

Further, while the above has been described in connection with an illustrative scenario in which the print-receiving tape 7 is fed out from the upper side of the roll TR, the present disclosure is not limited thereto, allowing application to a case where the print-receiving tape 7 is fed out from the lower side of the roll TR. In such a case, a force acts on the roll TR, attempting to roll the roll TR in the direction opposite the tape feed-out direction (toward the rearward side in this example), making it best to dispose the third roller 13 on the side opposite the feed-out direction side of the print-receiving tape 7 in contrast to the first and second rollers 11, 12.

Furthermore, while in the above position correction is performed on all pages PA, there is not necessarily a great disparity between the set interval and the actual length L, allowing therefore position correction to be performed on the next page (eleventh page) in a case where the count of the page counter that counts the number of printed pages PA (in other words, the label mounts 7B) reaches a predetermined number of pages (10 pages, for example). At this time, the predetermined number of pages may be set by the user, and can be changed or set in accordance with the distance from the above described P1 to P2 or the feeding direction length L of the page PA. Further, the apparent misalignment of the print result readily becomes more striking in proportion to the shortness of the length of the page PA, and therefore the number of predetermined pages decreases to the extent that the length along the feeding direction of the page PA is short.

Further, other than that already stated above, techniques based on the embodiment and each of the modifications may be suitably utilized in combination as well.

Although other examples are not individually described herein, various changes can be made according to the present disclosure without deviating from the spirit and scope of the disclosure.

What is claimed is:

1. A printer capable of forming desired printing while feeding a print-receiving tape, thereby producing a plurality of printed matter, the printer comprising:

a feeder configured to feed said print-receiving tape comprising a plurality of print-receiving portions, each of the plurality of print-receiving portions having a length L along a feeding direction, wherein each of said print-receiving portions comprises:

a separation material portion common to the plurality of print-receiving portions;

a print-receiving label portion separably affixed to said separation material portion; and a detected element for identifying said print-receiving portion, for each of said plurality of printed matter, wherein at least a portion of the detected element is formed on the separation material portion;

a printing head configured to form said desired printing on said print-receiving tape fed by said feeder;

a detecting device configured to detect said detected element of said plurality of print-receiving portions, provided on an upstream side of said printing head by a predetermined distance X that is longer than said length L, along said feeding direction;

a processor; and memory storing instructions that, when executed by the processor, cause the printer to:

determine whether said length L is less than a predetermined threshold value or not;

in a case that the length L is determined to be less than the threshold value:

generate a first positioning reference when said detecting device detects said detected element of a first print-receiving portion; and control said printing head when said detecting device detects said detected element of said first print-receiving portion, and perform printing on a second print-receiving portion preceding said first print-receiving portion along a feeding direction and facing said printing head, by using said generated first positioning reference, in a case that the length L is not determined to be less than the threshold value:

control said printing head when said detecting device detects said detected element of a first print-receiving portion, and perform printing on said first print-receiving portion facing said printing head, on the basis of the detection result.

2. The printer according to claim 1, wherein:

in the case that the length L is determined to be less than the threshold value, the instructions cause the printer to perform the generating of the first positioning reference and the controlling of the printing head, for every predetermined number of print-receiving portions including the first print-receiving portion and the second print-receiving portion.

* * * * *